US006341997B1

(12) United States Patent
Lin

(10) Patent No.: US 6,341,997 B1
(45) Date of Patent: Jan. 29, 2002

(54) METHOD FOR RECYCLING A POLISHING PAD CONDITIONING DISK

(75) Inventor: Yu-Liang Lin, Shin-Chu (TW)

(73) Assignee: Taiwan Semiconductor Manufacturing Company, Ltd, Hsin Chu (TW)

( * ) Notice: Subject to any disclaimer, the term of this patent is extended or adjusted under 35 U.S.C. 154(b) by 0 days.

(21) Appl. No.: 09/634,494

(22) Filed: Aug. 8, 2000

(51) Int. Cl.[7] ..... B24B 1/00

(52) U.S. Cl. ..... 451/39; 451/53; 451/54; 451/56; 451/444; 134/19; 134/22.18

(58) Field of Search ..... 451/38, 39, 40, 451/53, 54, 59, 56, 444, 443; 134/16, 17, 19, 22.18, 153, 199; 15/320

(56) References Cited

U.S. PATENT DOCUMENTS 5,599,223 A * 2/1997 Mains, Jr. ..... 451/39
5,616,069 A * 4/1997 Walker et al. ..... 451/56
5,749,772 A * 5/1998 Shimokawa ..... 451/53
5,779,522 A * 7/1998 Walker et al. ..... 451/56
5,957,750 A * 9/1999 Brunelli ..... 451/7
6,012,968 A * 1/2000 Lofaro ..... 451/39
6,053,801 A * 4/2000 Pinson et al. ..... 451/56

* cited by examiner

*Primary Examiner*—Eileen P. Morgan
(74) *Attorney, Agent, or Firm*—Tung & Associates

(57) ABSTRACT

A method for cleaning or recycling a polishing pad conditioning disk used in a chemical mechanical polishing apparatus is disclosed. In the method, a conditioning disk that has a top surface formed of diamond particles and covered by a layer of polishing debris such as silicon oxide is first provided. A water jet that has a pressure of at least 1,500 psi, or preferably, 3,000 psi is directed toward the top surface of the conditioning disk for at least 5 min., and preferably, for at least 10 min. to substantially remove the polishing debris. The conditioning disk is then positioned on a heated surface and heated to a temperature of at least 40° C. while simultaneously being blown by a flow of inert gas or $CO_2$ maintained at 0° C. or below on the top surface to remove any residual polishing debris by causing a thermal shock in the silicon oxide films and a separation from the conditioning disk.

18 Claims, 3 Drawing Sheets

METHOD FOR RECYCLING A POLISHING PAD CONDITIONING DISK

FIELD OF THE INVENTION

The present invention generally relates to a method for cleaning a conditioning disk for a polishing pad and more particularly, relates to a method for recycling a conditioning disk for polishing pad used in a chemical mechanical polishing apparatus by first directing a water jet on a top surface of the conditioning disk and then flowing an inert gas or $CO_2$ at a temperature of 0° C. or below onto the top surface of the conditioning disk while heating the disk to at least 40° C.

BACKGROUND OF THE INVENTION

Apparatus for polishing thin, flat semi-conductor wafers is well-known in the art. Such apparatus normally includes a polishing head which carries a membrane for engaging and forcing a semiconductor wafer against a wetted polishing surface, such as a polishing pad. Either the pad, or the polishing head is rotated and oscillates the wafer over the polishing surface. The polishing head is forced downwardly onto the polishing surface by a pressurized air system or, similar arrangement. The downward force pressing the polishing head against the polishing surface can be adjusted as desired. The polishing head is typically mounted on an elongated pivoting carrier arm, which can move the pressure head between several operative positions. In one operative position, the carrier arm positions a wafer mounted on the pressure head in contact with the polishing pad. In order to remove the wafer from contact with the polishing surface, the carrier arm is first pivoted upwardly to lift the pressure head and wafer from the polishing surface. The carrier arm is then pivoted laterally to move the pressure head and wafer carried by the pressure head to an auxiliary wafer processing station. The auxiliary processing station may include, for example, a station for cleaning the wafer and/or polishing head, a wafer unload station, or a wafer load station.

More recently, chemical-mechanical polishing (CMP) apparatus has been employed in combination with a pneumatically actuated polishing head. CMP apparatus is used primarily for polishing the front face or device side of a semiconductor wafer during the fabrication of semiconductor devices on the wafer. A wafer is "planarized" or smoothed one or more times during a fabrication process in order for the top surface of the wafer to be as flat as possible. A wafer is polished by being placed on a carrier and pressed face down onto a polishing pad covered with a slurry of colloidal silica or alumina in de-ionized water.

A schematic of a typical CMP apparatus is shown in FIGS. 1A and 1B. The apparatus 20 for chemical mechanical polishing consists of a rotating wafer holder 14 that holds the wafer 10, the appropriate slurry 24, and a polishing pad 12 which is normally mounted to a rotating table 26 by adhesive means. The polishing pad 12 is applied to the wafer surface 22 at a specific pressure. The chemical mechanical polishing method can be used to provide a planar surface on dielectric layers, on deep and shallow trenches that are filled with polysilicon or oxide, and on various metal films. CMP polishing results from a combination of chemical and mechanical effects. A possible mechanism for the CMP process involves the formation of a chemically altered layer at the surface of the material being polished. The layer is mechanically removed from the underlying bulk material. An altered layer is then regrown on the surface while the process is repeated again. For instance, in metal polishing a metal oxide may be formed and removed repeatedly.

A polishing pad is typically constructed in two layers overlying a platen with the resilient layer as the outer layer of the pad. The layers are typically made of polyurethane and may include a filler for controlling the dimensional stability of the layers. The polishing pad is usually several times the diameter of a wafer and the wafer is kept off-center on the pad to prevent polishing a non-planar surface onto the wafer. The wafer is also rotated to prevent polishing a taper into the wafer. Although the axis of rotation of the wafer and the axis of rotation of the pad are not collinear, the axes must be parallel.

In a CMP head, large variations in the removal rate, or polishing rate, across the whole wafer area are frequently observed. A thickness variation across the wafer is therefore produced as a major cause for wafer non-uniformity. In the improved CMP head design, even though a pneumatic system for forcing the wafer surface onto a polishing pad is used, the system cannot selectively apply different pressures at different locations on the surface of the wafer. This effect is shown in FIG. 1C, i.e. in a profilometer trace obtained on an 8-inch wafer. The thickness difference between the highest point and the lowest point on the wafer is almost 2,000 Å resulting in a standard deviation of 472 Å or 6.26%. The curve shown in FIG. 1C is plotted with the removal rates in the vertical axis and the distance from the center of the wafer in the horizontal axis. It is seen that the removal rates obtained at the edge portions obtained of the wafer are substantially higher than the removal rates at or near the center of the wafer. The thickness uniformity on the resulting wafer after the CMP process is poor.

The polishing pad 12 is a consumable item used in a semiconductor wafer fabrication process. Under normal wafer fabrication conditions, the polishing pad is replaced after about 12 hours of usage. Polishing pads may be hard, incompressible pads or soft pads. For oxide polishing, hard and stiffer pads are generally used to achieve planarity. Softer pads are generally used in other polishing processes to achieve improved uniformity and smooth surface. The hard pads and the soft pads may also be combined in an arrangement of stacked pads for customized applications.

A problem frequently encountered in the use of polishing pads in oxide planarization is the rapid deterioration in oxide polishing rates with successive wafers. The cause for the deterioration is known as "pad glazing" wherein the surface of a polishing pad becomes smooth such that the pad no longer holds slurry in-between the fibers. This is a physical phenomenon on the pad surface not caused by any chemical reactions between the pad and the slurry.

To remedy the pad glazing effect, numerous techniques of pad conditioning or scrubbing have been proposed to regenerate and restore the pad surface and thereby, restoring the polishing rates of the pad. The pad conditioning techniques include the use of silicon carbide particles, diamond emery paper, blade or knife for scrapping the polishing pad surface. The goal of the conditioning process is to remove polishing debris from the pad surface, re-open the pores, and thus forms micro-scratches in the surface of the pad for improved life time. The pad conditioning process can be carried out either during a polishing process, i.e. known as concurrent conditioning, or after a polishing process.

While the pad conditioning process improves the consistency and lifetime of a polishing pad, a conventional conditioning disk is frequently not effective in conditioning a pad surface after repeated usage. A conventional conditioning disk for use in pad conditioning is shown in FIGS. 2A, 2B and 2C.

Referring now to FIG. 2A, wherein a perspective view of a CMP apparatus 50 is shown. The apparatus 50 consists of a conditioning head 52, a polishing pad 56, and a slurry delivery arm 54 positioned over the polishing pad. The conditioning head 52 is mounted on a conditioning arm 58 which is extended over the top of the polishing pad 56 for making sweeping motion across the entire surface of the pad. The slurry delivery arm 54 is equipped with slurry dispensing nozzles 62 which are used for dispensing a slurry solution on the top surface 60 of the polishing pad 56. Surface grooves 64 are further provided in the top surface 60 to facilitate even distribution of the slurry solution and to help entrapping undesirable particles that are generated by coagulated slurry solution or any other foreign particles which have fallen on top of the polishing pad during a polishing process. The surface grooves 64 while serving an important function of distributing the slurry also presents a processing problem when the pad surface 60 gradually worn out after successive use.

The conditioning disk 68, shown in FIGS. 2B and 2C, are formed by embedding or encapsulating diamond particles 32 in nickel 34 coated on the surface 36 of a rigid substrate 38. FIG. 2B is a cross-sectional view of a new conditioning disk with all the diamond particles 32 embedded in nickel 34. In the fabrication of the diamond particle conditioning disk 68, a nickel encapsulant 34 is first mixed with a diamond grit which includes diamond particles 32 and then applied to the rigid substrate 38. After repeated usage, a cross-sectional view of disk 68 is shown in FIG. 2C which shows that diamond particle 32 are embedded in a layer 40 of silicon oxide, i.e. after an oxide CMP process. The formation of the solid $SiO_2$ film 40 embedding the diamond particles is inevitable after repeated oxide CMP processes. Once the diamond particles 32 are embedded in the hard film of silicon oxide, the conditioning disk loses its effectiveness in conditioning a polishing pad since the diamond particles 32 are no longer protruded.

It is therefore an object of the present invention to provide a method for cleaning a conditioning disk that does not have the drawbacks or shortcomings of the conventional cleaning method.

It is another object of the present invention to provide a method for cleaning a conditioning disk by using a high pressure water jet.

It is a further object of the present invention to provide a method for cleaning a conditioning disk by utilizing a water jet that has at least 1,500 psi pressure.

It is another further object of the present invention to provide a method for cleaning a conditioning disk by using a combination water jet cleaning and low temperature inert gas or $CO_2$ blowing process.

It is still another further object of the present invention to provide a method for cleaning a conditioning disk by first flushing the disk with a high pressure water jet, and then heating the disk to a temperature of at least 40° C. while blowing an inert gas or $CO_2$ at below 0° C. onto the surface of the disk.

It is yet another object of the present invention to provide a method for recycling a conditioning disk such that silicon oxide films accumulated on the surface of the disk can be effectively removed and the disk may be reused.

SUMMARY OF THE INVENTION

In accordance with the present invention, a method for cleaning or recycling a polishing pad conditioning disk by utilizing a water jet cleaning process and an inert gas or $CO_2$ blowing process is disclosed.

In a preferred embodiment, a method for cleaning a conditioning disk can be carried out by the operating steps of first providing a conditioning disk that has a top surface covered with polishing debris, directing a water jet of at least 1,500 psi pressure toward the top surface for at least 5 min. to substantially remove the polishing debris, and then heating the conditioning disk to a temperature of at least 40° C. while simultaneously directing a flow of inert gas or $CO_2$ at a temperature of 0° C. or below onto the top surface to remove any residual polishing debris.

The method for cleaning a polishing pad conditioning disk may further include the step of removing polishing debris of silicon oxide after an oxide CMP process. The method may further include the step of providing a diamond conditioning disk covered with a film of $SiO_2$. The method may further include the step of directing a water jet that has a pressure between about 1,500 psi and about 5,000 psi toward the top surface of the conditioning disk. The method may further include the step of directing a water jet that has preferably a pressure of about 3,500 psi toward the top surface of the conditioning disk, or the step of directing a water jet formed of deionized water toward the top surface of the conditioning disk.

The method for cleaning a polishing pad conditioning disk may further include the step of providing a water jet nozzle that has a nozzle opening with a diameter between about 0.1 mm and about 0.5 mm, or the step of providing a water jet nozzle that has a nozzle opening with a diameter of preferably about 0.3 mm. The method may further include the step of directing the water jet toward the top surface for a time period between about 5 min. and about 30 min.

The method may further include the step of heating the conditioning disk to a temperature between about 30° C. and about 60° C. The method may further include the step of directing a flow of an inert gas or $CO_2$ selected from the group consisting of $N_2$, He, Ar and $CO_2$. The method may further include the step of peeling off any residual $SiO_2$ film from the top surface of the conditioning disk when the heated film is cooled by the flow of inert gas or $CO_2$, or the step of directing a flow of clean dried air (CDA) at a temperature of 0° C. or below onto the top surface to remove residual polishing debris.

The present invention is further directed to a method for recycling a polishing pad conditioning disk that can be carried out by the steps of first providing a conditioning disk that has a top surface formed of diamond particles and covered by a $SiO_2$ film, directing a water jet of at least 3,000 psi pressure toward the top surface for at least 10 min. to substantially remove the $SiO_2$ film, and then positioning the conditioning disk on a heated surface for heating the disk to a temperature of at least 40° C., while simultaneously flowing an inert gas or $CO_2$ maintained at less than 0° C. onto the top surface to remove residual $SiO_2$ film.

In the method for recycling a polishing pad conditioning disk, the conditioning disk may have been used in a CMP silicon oxide process. The method may further include the step of directing a water jet at between about 3,000 psi and about 5,000 psi pressure toward the top surface of the conditioning disk for at least 10 min. The flow of inert gas or $CO_2$ may be at least one gas selected from the group consisting of $N_2$, He, Ar and $CO_2$. A thermal shock occurs in the residual $SiO_2$ films when contacted by the flow of low temperature inert gas or $CO_2$, i.e. maintained at less than 0°C., to facilitate the removal of the film from the conditioning disk.

BRIEF DESCRIPTION OF THE DRAWINGS

These and other objects, features and advantages of the present invention will become apparent from the following detailed description and the appended drawings in which:

FIG. 1B is an enlarged, cross-sectional view of a section of the wafer and the polishing pad with a slurry solution therein between.

DETAILED DESCRIPTION OF THE PREFERRED EMBODIMENT

The present invention discloses a method for cleaning a polishing pad conditioning disk which can be carried out by first providing a conditioning disk that has a top surface of diamond particles covered with polishing debris, such as silicon oxide. A water jet that has a pressure of at least 1,500 psi is first directed at the top surface for at least 5 min. to substantially remove the polishing debris of silicon oxide. The conditioning disk is then positioned and heated on a heated surface to a temperature of at least 40° C. while simultaneously blown by a flow of inert gas or $CO_2$ maintained at or below 0° C. to remove the residual polishing debris.

The present invention further discloses a method for recycling a polishing pad conditioning disk which can be carried out by first providing a used conditioning disk that has a top surface formed of diamond particles and covered by a silicon oxide film. A water jet of at least 3,000 psi pressure is then directed toward the top surface for at least 10 min. to substantially remove the silicon oxide film. The conditioning disk is then positioned on a heated surface and heated to a temperature of at least 40° C. while simultaneously blown by an inert gas or $CO_2$ maintained at or below 0° C. to remove residual silicon oxide films by causing a thermal shock in the films.

Figure 1A:
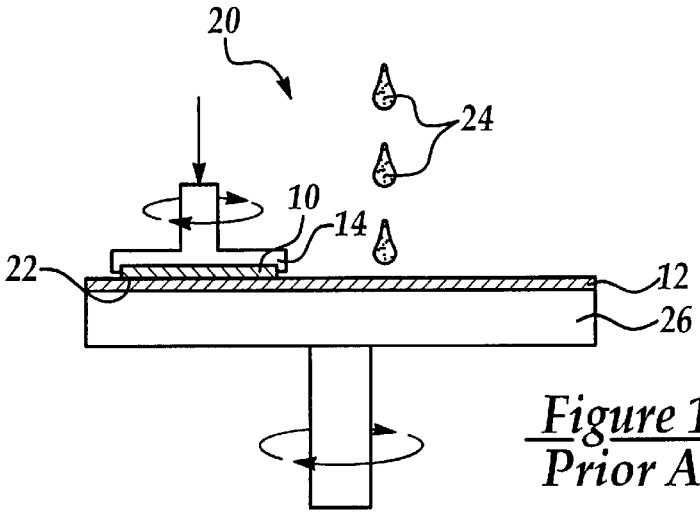
Figure 1A Prior Art
FIG. 1A is a cross-sectional view of a conventional chemical mechanical polishing apparatus.
Figure 1B:
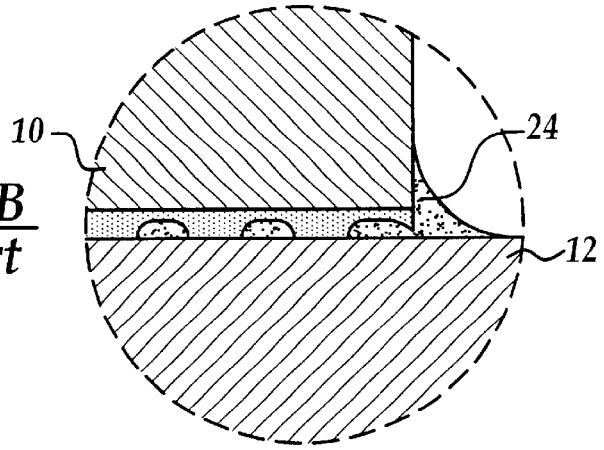
Figure 1B Prior Art
Figure 1C:
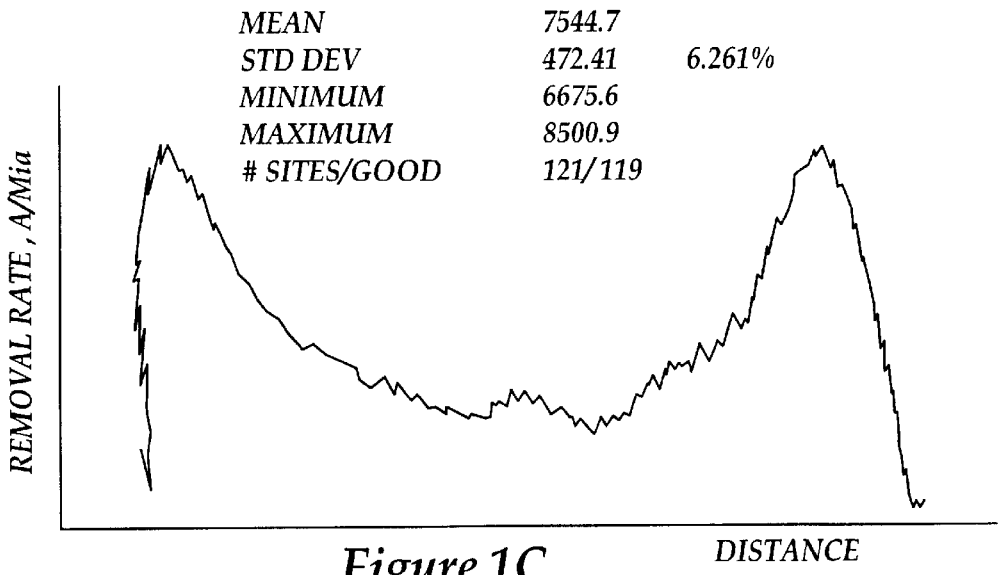
Figure 1C Prior Art
FIG. 1C is a graph illustrating the changes in removal rates as a function of distance on a wafer after a polishing pad is repeatedly used.
Figure 2A:
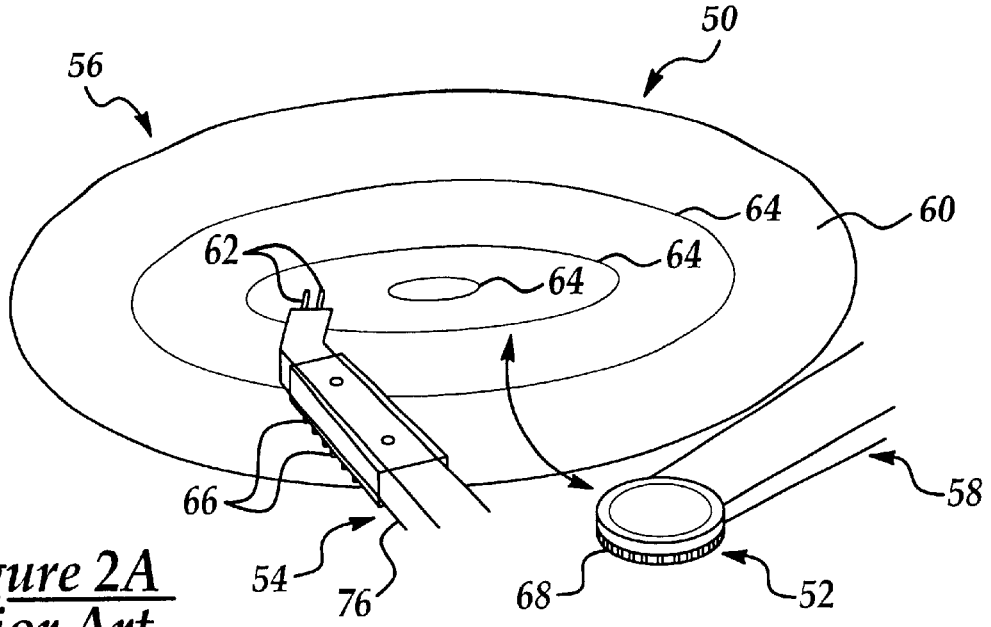
Figure 2A Prior Art
FIG. 2A is a perspective view of a conventional CMP polishing pad with a slurry dispensing arm and a conditioning disk positioned on top.
Figure 2B:
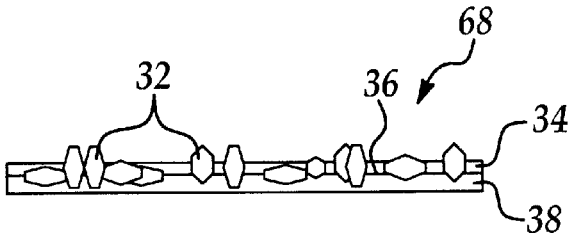
Figure 2B Prior Art
FIG. 2B is a cross-sectional view of a conventional diamond conditioning disk.
Figure 2C:
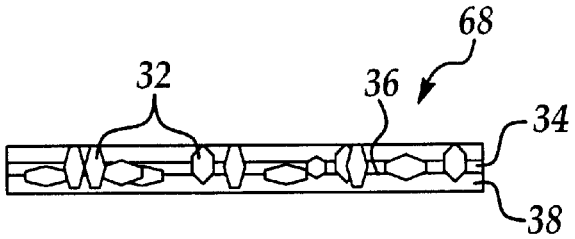
Figure 2C Prior Art
FIG. 2C is the conventional conditioning disk of FIG. 2B covered with a film of $SiO_2$.
Figure 3:
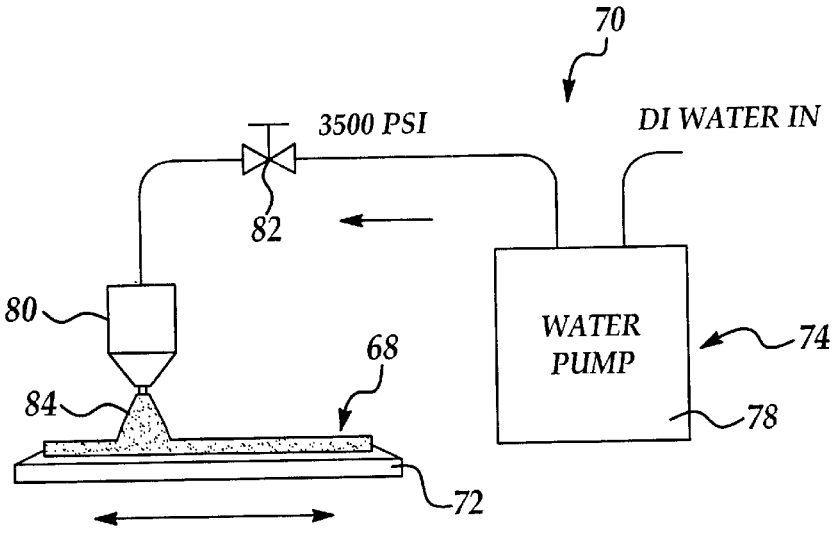
FIG. 3 is an illustration of the present invention water jet cleaning apparatus.

Referring now to FIG. 3, wherein the present invention apparatus 70 is shown. The apparatus 70 is first provided with a traversing table 72 that can be moved in an X–Y position with a polishing disk 68 positioned on top. A water pump 74 which is filled with deionized water 78 is then fed through a control valve 82 to a spray nozzle head 80 for spraying droplets 84 of deionized water onto the surface of the conditioning disk 68. Polishing debris films, which are most likely formed of silicon oxide, are substantially removed by spray 84 of deionized water under a pressure between about 1,500 psi and about 5,000 psi, and preferably, at about 3,500 psi. The word "substantially" used in the context of this writing indicates a range of approximately between 70% and 80%. The time required for spraying the conditioning disk to substantially remove the silicon oxide film is between about 5 min. and about 30 min. The word "about" used in the context of this writing indicates a range of values that is ±10% of the average value given.

While deionized water (DI water) is used in one embodiment of the present invention method, other suitable solvents such as ultra pure water may also be used to flush away the $Sio_2$ film.

Figure 4:
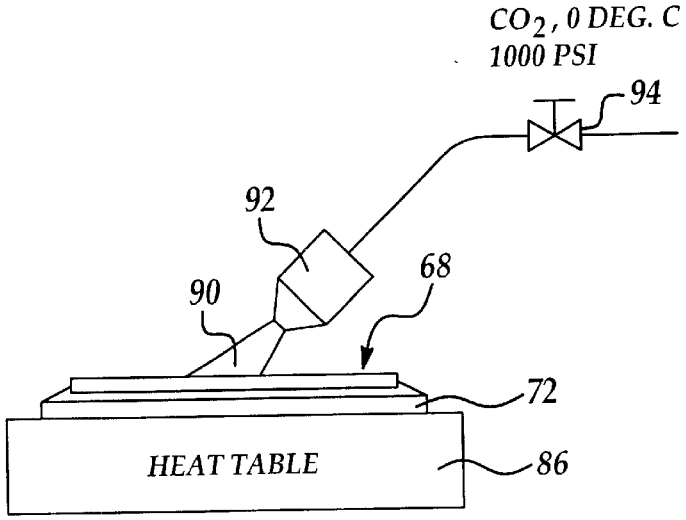
FIG. 4 is an illustration of the present invention method with the conditioning disk positioned on a heating table and blown by low temperature inert gas or $CO_2$.

After the water jet cleaning process is completed in a time period of about 15 min., as shown in FIG. 3, the conditioning disk 68 (carried on a traversing table 72) is positioned on a heating table 86 for heating to a temperature of at least 40° C. and preferably, to a temperature between about 40° C. and about 60°C. while simultaneously flowing an inert gas or $CO_2$ maintained at 0° C. or below onto the top surface of the conditioning disk 68 to remove any residual polishing debris. This is shown in FIG. 4. It is the unique discovery of the present invention that by flowing a low temperature inert gas or $CO_2$ onto a heated conditioning disk heated to a temperature of at least 40°C. residual polishing debris of $SiO_2$ films are thermally shock and peeled off from the surface of the conditioning disk.

A suitable size of the water jet nozzle utilized is between about 0.1 and about 0.5 mm in diameter, and preferably, 0.3 mm in diameter.

As shown in FIG. 4, a low temperature inert gas or $CO_2$ flow 90 from gas spray nozzle 92 impinges on the top surface of the conditioning disk 68 causing a thermal shock in the $SiO_2$ films. The flow of low temperature inert gas or $CO_2$ at 0° C. is controlled by flow valve 94 at 1,000 psi pressure. A suitable inert gas includes $N_2$, He or Ar.

The present invention novel method may further include an optional rinsing step by immersing the conditioning disk 68 mounted on the traversing table 72 in a water tank 100 filled with deionized water 78. The deionized water 78 may be agitated by an ultrasonic device (not shown) to further improve the cleaning efficiency of the DI water.

Figure 5:
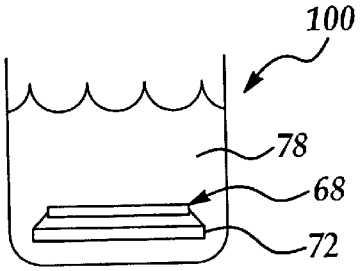
FIG. 5 is an illustration of an optional step of the present invention method in which the conditioning disk is rinsed in a water tank.

The present invention novel method for cleaning or recycling a polishing pad conditioning disk for a chemical mechanical polishing apparatus has therefore been amply described in the above description and in the appended drawings of FIGS. 3, 4 and 5.

While the present invention has been described in an illustrative manner, it should be understood that the terminology used is intended to be in a nature of words of description rather than of limitation.

Furthermore, while the present invention has been described in terms of a preferred embodiment, it is to be appreciated that those skilled in the art will readily apply these teachings to other possible variations of the inventions.

The embodiment of the invention in which an exclusive property or privilege is claimed are defined as follows.

What is claimed is:

1. A method for cleaning a polishing pad conditioning disk comprising the steps of:

providing a conditioning disk having a top surface covered with polishing debris;

directing a water jet of at least 1,500 psi pressure toward said top surface for at least 5 min. to substantially remove said polishing debris; and heating the conditioning disk to a temperature of at least 30° C. while simultaneously directing a flow of inert gas or $CO_2$ maintained at 0° C. or below onto said top surface to remove residual polishing debris.

2. A method for cleaning a polishing pad conditioning disk according to claim 1 further comprising the step of removing polishing debris of silicon oxide after an oxide CMP process.

3. A method for cleaning a polishing pad conditioning disk according to claim 1 further comprising the step of providing a diamond conditioning disk covered with a film of $SiO_2$.

4. A method for cleaning a polishing pad conditioning disk according to claim 1 further comprising the step of directing a water jet having a pressure between about 1,500 psi and about 5,000 psi toward said top surface of said conditioning disk.

5. A method for cleaning a polishing pad conditioning disk according to claim 1 further comprising the step of directing a water jet having preferably a pressure of about 3,500 psi toward said top surface of said conditioning disk.

6. A method for cleaning a polishing pad conditioning disk according to claim 1 further comprising the step of directing a water jet of deionized water toward said top surface of said conditioning disk.

7. A method for cleaning a polishing pad conditioning disk according to claim 1 further comprising the step of providing a water jet nozzle having a nozzle opening of between about 0.1 mm and about 0.5 mm in diameter.

8. A method for cleaning a polishing pad conditioning disk according to claim 1 further comprising the step of providing a water jet nozzle having a nozzle opening with a diameter of preferably about 0.3 mm.

9. A method for cleaning a polishing pad conditioning disk according to claim 1 further comprising the step of directing said water jet toward said top surface for a time period between about 5 min. and about 30 min.

10. A method for cleaning a polishing pad conditioning disk according to claim 1 further comprising the step of heating said conditioning disk to a temperature between about 30° C. and about 60° C.

11. A method for cleaning a polishing pad conditioning disk according to claim 1 further comprising the step of directing a flow of an inert gas or $CO_2$ selected from the group consisting of $N_2$, He, Ar and $CO_2$.

12. A method for cleaning a polishing pad conditioning disk according to claim 1 further comprising the step of peeling off residual $SiO_2$ films from said top surface of the conditioning disk when said films are cooled by said flow of inert gas or $CO_2$.

13. A method for cleaning a polishing pad conditioning disk according to claim 1 further comprising the step of directing a flow of clean dried air (CDA) at a temperature of 0° C. or below onto said top surface to remove residual polishing debris.

14. A method for recycling a polishing pad conditioning disk comprising the steps of:

providing a used conditioning disk having a top surface formed of abrasive particles and covered by a $SiO_2$ film;

directing a water jet of at least 3,000 psi pressure toward said top surface for at least 10 min. to substantially remove said $SiO_2$ film; and positioning said conditioning disk on a heated surface and heating said disk to a temperature of at least 400°C., while simultaneously flowing an inert gas or $CO_2$ maintained at or below 0° C. onto said top surface to remove residual $SiO_2$ film.

15. A method for recycling a polishing pad conditioning disk according to claim 14 wherein said used conditioning disk has been used in a CMP silicon oxide process.

16. A method for recycling a polishing pad conditioning disk according to claim 14 further comprising the step of directing a water jet of between about 3,000 psi and about 5,000 psi pressure toward said top surface for at least 10 min.

17. A method for recycling a polishing pad conditioning disk according to claim 14, wherein said flow of inert gas or $CO_2$ is at least one gas selected from the group consisting of $N_2$, He, Ar and $CO_2$.

18. A method for recycling a polishing pad conditioning disk according to claim 14, wherein a thermal shock occurs in said residual $SiO_2$ film when contacted by said flow of inert gas or $CO_2$ maintained at or below 0° C. to facilitate the removal of said film from said conditioning disk.

* * * * *